US007192333B2

(12) United States Patent
Ward

(10) Patent No.: US 7,192,333 B2
(45) Date of Patent: Mar. 20, 2007

(54) BRA THAT FACILITATES BREATHING

(76) Inventor: Delane Ward, 9355 113th St., Semiole, FL (US) 33772-9998

( * ) Notice: Subject to any disclaimer, the term of this patent is extended or adjusted under 35 U.S.C. 154(b) by 1 day.

(21) Appl. No.: 11/197,797

(22) Filed: Aug. 5, 2005

(65) Prior Publication Data

US 2007/0032167 A1 Feb. 8, 2007

(51) Int. Cl.
*A41C 3/10* (2006.01)
*A41C 3/12* (2006.01)

(52) U.S. Cl. ..... 450/41; 450/92; 450/93

(58) Field of Classification Search ..... 450/41, 450/45, 48, 4, 65, 66, 72, 71, 74–76, 70, 450/92, 93

See application file for complete search history.

(56) References Cited

U.S. PATENT DOCUMENTS 2,763,010 A * 9/1956 Rosenthal ..... 450/70
2,881,765 A * 4/1959 Sloate ..... 450/65
2,912,983 A * 11/1959 Horn ..... 450/45
2,954,031 A * 9/1960 Froehlich ..... 450/48
3,082,771 A * 3/1963 Bruno ..... 450/70
3,131,696 A * 5/1964 Krakower et al. ..... 450/41
3,393,682 A * 7/1968 Cole ..... 450/66
3,717,154 A * 2/1973 Spetalnik ..... 450/70
5,904,607 A * 5/1999 Abadi ..... 450/3
6,019,662 A * 2/2000 Fildan ..... 450/41

* cited by examiner

*Primary Examiner*—Gloria M. Hale
(74) *Attorney, Agent, or Firm*—Cherskov & Flaynik

(57) ABSTRACT

A bra is provided that facilitates a woman's breathing. The bra comprises a lower portion with an inverted V shape that skirts the woman's diaphragm. This lower portion is bordered by an elastic band. This bra is especially suitable as a sports bra.

4 Claims, 3 Drawing Sheets

BRA THAT FACILITATES BREATHING

FIELD OF THE INVENTION

The present invention relates to the field of female clothing and, more specifically, the present invention relates to the field of brassieres.

BACKGROUND OF THE INVENTION

A bane of many women's existence is the absence of clothing that provides adequate support for a woman's bosom without at the same time pressing on her upper diaphragm. Pressure on the upper diaphragm causes pain and discomfort and hampers breathing. Pressure on the upper diaphragm is most disadvantageous while the wearer is engaging in strenuous physical activity. Such pressure prevents the wearer from performing at her best during intense sports competition.

Many bras provide adequate support even when the wearer is participating in sports. For typical sports bras see for instance, most recently, U.S. Pat. No. D438,691 (Zagame); U.S. Pat. No. 6,755,717 (Smith); U.S. Pat. No. 6,083,080 (Lawson et. al); and U.S. Pat. No. 4,617,934 (Hittel). These designs have the disadvantage of having a strap extending across a wearer's diaphragm thus hampering her breathing at full capacity.

Thus there is a need in the art for a bra that provides adequate support to a woman's bosom without applying pressure on her diaphragm and thus interfering with her breathing. Such a bra would be most advantageous while the woman is participating in sports and aerobic activity generally.

SUMMARY OF THE INVENTION

An object of the present invention is to provide a bra that overcomes the disadvantages in the prior art.

Another object of the present invention is to provide a bra that does not interfere with a woman's breathing. A feature of the present invention is that it comprises a bottom-most edge defining an inverted V shape. An advantage of the present invention is that it does not apply pressure on the woman's diaphragm.

Still another object of the present invention is to provide a bra that facilitates a woman's participation in sports. A feature of the present invention is the combined use of high tensile strength fabric and elastic bordering bands on a depending, horizontally-disposed edge of the bra that applies no pressure on a wearer's diaphragm. An advantage of the present invention is that the it provides adequate support while it allows full freedom of movement.

In brief, this invention provides a bra to permit unhindered movement of a wearer's diaphragm, the bra comprising a generally cylindrical body having a first depending edge, a second upwardly directed edge, and anteriorly extending convex regions, whereby the convex regions are adapted to receive a woman's breasts; a plurality of straps extending upwardly from the second edge; and an elastic substrate integrally formed with the first edge and with the convex regions to define an inverted V between the convex regions.

BRIEF DESCRIPTION OF THE DRAWING

The invention together with the above and other objects and advantages will best be understood from the following detailed description of the preferred embodiment of the invention shown in the accompanying drawing, wherein.

DETAILED DESCRIPTION OF THE INVENTION

The present invention provides a brassiere that is adapted to permit unhindered movement of a wearer's diaphragm. Generally, the bra comprises a lower periphery adapted to be situated above the wearer's diaphragm when the bra is in use. The invented bra affords full support to the wearer at the same time as it allows full mobility and unimpeded breathing.

Figure 1:
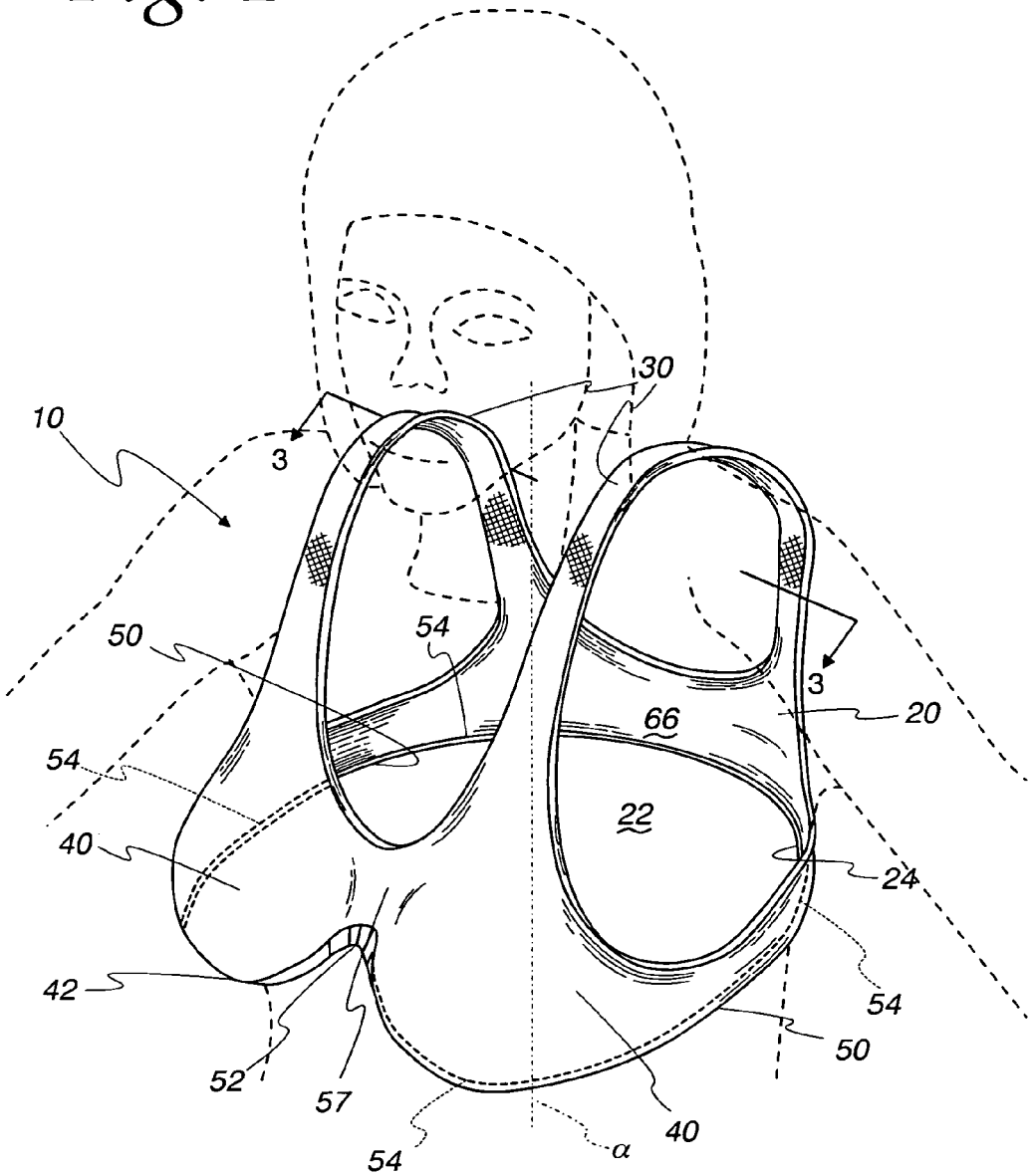
FIG. 1 is a perspective view of a brassiere when worn by a user, in accordance with features of the present invention.

Referring to FIG. 1, an exemplary embodiment of the invented brassiere is schematically depicted as numeral 10. For illustration purposes only, the brassiere 10 is depicted as being of the slip-on type. It illustrates the brassiere's configuration when worn by a user. Generally, the bra comprises a body 20 adapted to encircle the wearer's torso, and two shoulder straps 30, generally extending in a direction that is perpendicular to the periphery of the body 20. The front of the bra further comprises two cups 40 arranged in a typical convex configuration radially directed outwardly from a centerline a of the bra. The body 20, straps 30, and cups 40 are integrally molded with each other.

The body 20 of the brassiere defines an opening 22 through which the wearer inserts her head and shoulders when donning the brassiere.

The cups 40 are separated by a depending border region 50, integrally formed with the cups so as to define a depending portion of the cups and extending substantially the entire circumference of a depending periphery 24 of the body 20. As such, when the bra is being worn, the border region 50 is positioned so as to rest on the sternum, and above the region through which the diaphragm rises and falls.

Figure 2:
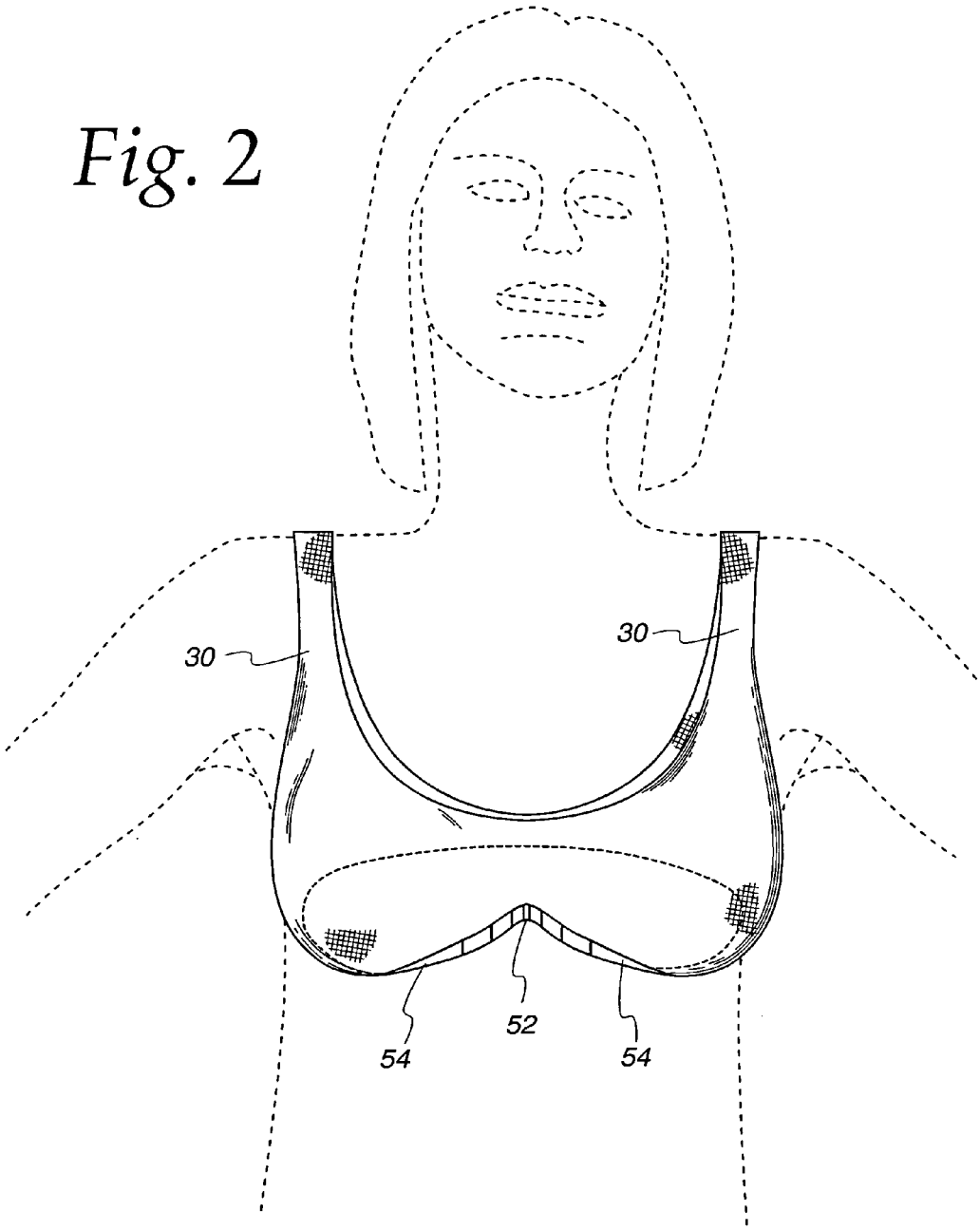
FIG. 2 is a front view of a brassiere when warn by a user, in accordance with features of the present invention.
Figure 3:
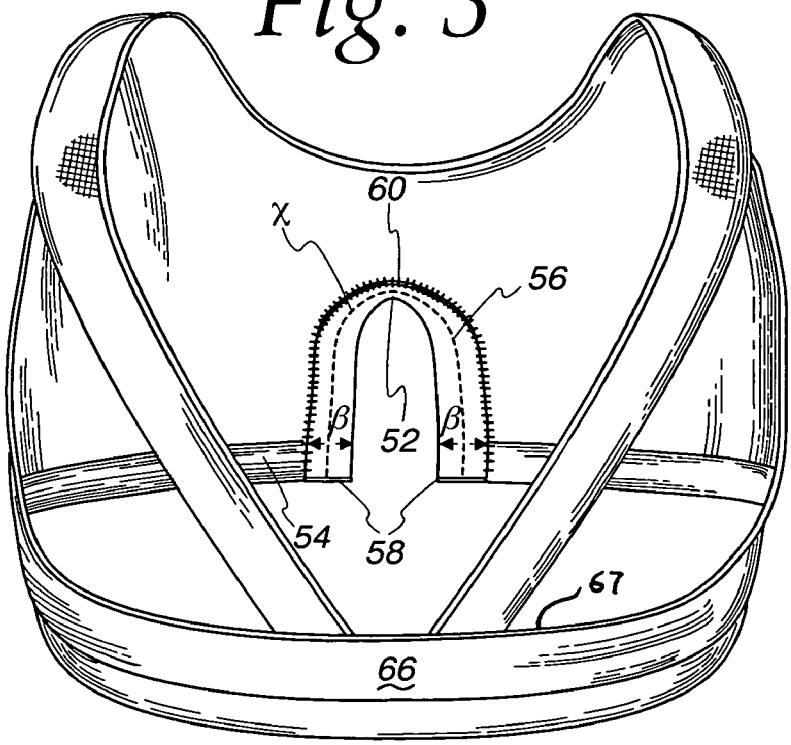
FIG. 3 is an inside view of the brassiere, taken along line 3—3 in FIG. 1, in accordance with features of the present invention.

The border region 50 is lined with an elastic band 54, the band denoted in the anterior portion of the bra in FIG. 1 via a dotted line, and in FIGS. 2 and 3. Either a continuous band, or several elastic substrates joined to make a continuous band, will suffice. A forward (i.e. anterior-facing, relative to the wearer) surface or portion 52 of the border region 50 defines the shape of an inverted V. The elastic-border/inverted-V combination provides more comfort and mobility than the wire-bordered cups presently available.

As depicted in FIG. 3, the stitching defining the inverted V instills a transverse and upward pull (from the front to the back, i.e. from ventral to dorsal) of the cups. This pulling force minimizes downward pressure from the breasts on the diaphragm. The inverted V also ensures that the bra rests above the area of the rising and falling motion of the diaphragm. Such rising and falling motion is of course marked during aerobic exercise.

An elongate, flat elastic substrate 56 contiguous with the elastic band 54 defines the periphery of the V, the elongate substrate having a pair of depending ends 58 and a pinnacle or apex region 60, positioned superior to and intermediate the depending ends 58. At the point where the depending ends 58 meet the forward surface 52, the plane of the substrate defined by the laterally extending portion or width (i.e. breadth β) of the substrate is coplanar with the front is piece or forward surface 57 of the brassiere. In contrast, at the point where the apex region 60 of the substrate meets the forward surface 57 of the brassiere, the laterally extending portion of the substrate is positioned and attached perpendicular to the plane defining the forward surface. As such, the longitudinal axis X of the substrate is rotated 90 degrees between its ends 58 and its midpoint 60.

The elastic band 60 may be made to encircle all of the wearer's torso, including the back portion 66.

Best support is obtained when a high tensile strength fabric is chosen for the body of the brassiere. In instances where more fully endowed females are using the brassiere, the middle of the back panel 66 of the bra contains elastic material. That way, the high tensile strength fabric on either side of the elastic is pulled together, toward the middle. However, the elastic depending border band 54 of the garment is crucial in keeping the article positioned during use. In general, a variety of configurations may be used for the back of the bra. FIG. 3 depicts an alternate embodiment wherein the two shoulder straps form a V as they extend down the back to attach to an upwardly-directed edge 67 of the back panel 66 of the bra. It is noteworthy that this "V" opens upwardly compared to the inverted "V" in the front of the garment which opens downwardly, thereby confirming additional upward pressure on the breasts of the wearer.

If necessary, the under-portion of the cups 40 may be lined with additional supporting material (not shown) for comfort.

The brassiere 10 shown in FIG. 1 is of the slip-on type. The present invention may be implemented with a brassiere that hooks (or otherwise reversibly closes) in front or behind. Also, the shoulder straps may be adjustable.

FIG. 2 depicts a front view of the invented bra. FIG. 2 depicts more clearly the inverted V feature of the garment. Also shown is the elastic substrate or band 54 which forms the V and also extends medially from either side of the V. As stated supra, the elastic substrate is stitched/sown into the body 20 of the bra and defines the periphery 24 of the depending edge of the garment, that edge forming the opening 22 through which the wearer extends her head and shoulders when donning the garment.

Figure 4:
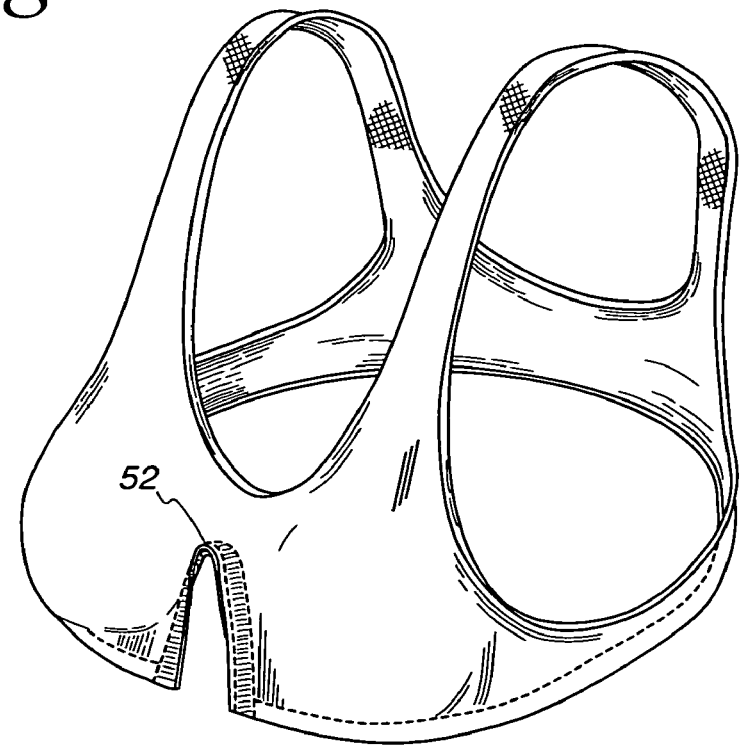
FIG. 4 is a perspective view of a brassiere when not warn by a user, in accordance with features of the present invention.

FIG. 4 depicts a perspective view of the invented bra when it not in use. It depicts especially clearly the inverted V feature of the garment. FIG. 4 further depicts the approximate 90 degree rotation of the elastic band 54. It is this rotation which confers upwardly and dorsally directed pressure on the breasts of the wearer. While the invention has been described in the foregoing with reference to details of the illustrated embodiment, these details are not intended to limit the scope of the invention as defined in the appended claims. Generally, a sports bra is provided to render excellent support, full range of motion, and, especially, unhindered movement of a wearer's diaphragm.

The invention claimed is:

1. A bra to permit unhindered movement of a wearer's diaphragm, the bra comprising:

a) a generally cylindrical body having a first depending edge, a second upwardly directed edge, a forward surface, and anteriorly extending convex regions, whereby the convex regions are adapted to receive a woman's breasts;

b) a plurality of straps extending upwardly from the second edge; and c) an elastic substrate integrally formed with the first edge and with the convex regions to define an inverted V between the convex regions wherein said inverted V has two depending ends and an apex such that the elastic substrate is coplanar to said forward surface at said depending ends and perpendicular to said forward surface at said apex.

2. The bra as recited in claim 1 wherein the depending edge defines a circle with a periphery and said elastic substrate extends substantially along the entire periphery of the circle.

3. The bra as recited in claim 2 wherein said elastic substrate is continuous.

4. The bra as recited in claim 1 wherein the bra is adapted to be positioned above the diaphragm of the wearer when worn.

* * * * *